US006467845B1

(12) United States Patent
Chen

(10) Patent No.: US 6,467,845 B1
(45) Date of Patent: Oct. 22, 2002

(54) CHAIR WITH A LOCKING UNIT

(76) Inventor: Su-Ming Chen, No. 566, Fong-Lin 2nd Rd., Ta-Liao Hsiang, Kaohsiung Hsien (TW)

( * ) Notice: Subject to any disclaimer, the term of this patent is extended or adjusted under 35 U.S.C. 154(b) by 0 days.

(21) Appl. No.: 09/957,835

(22) Filed: Sep. 21, 2001

(51) Int. Cl.[7] ..... A47C 7/60
(52) U.S. Cl. ..... 297/374; 297/300.8; 297/463.1
(58) Field of Search ..... 297/374, 300.8, 297/303.1, 300.2, 463.1

(56) References Cited

U.S. PATENT DOCUMENTS 5,356,200 A * 10/1994 Stumpf et al. ..... 297/301.1
5,423,595 A * 6/1995 Hancock ..... 188/167
5,588,706 A * 12/1996 Neumueller et al. ..... 297/374
5,676,425 A * 10/1997 Pernicka ..... 297/374
5,863,099 A * 1/1999 Hancock ..... 297/374

* cited by examiner

*Primary Examiner*—Anthony D. Barfield
*Assistant Examiner*—Erika Garrett
(74) *Attorney, Agent, or Firm*—Christie, Parker & Hale, LLP

(57) ABSTRACT

A locking unit includes a frame to permit extension of a bolt. An upper portion of a bracket is pivoted to left and right side walls of the frame. A linking member has a rear part connected to the bracket, and a front part formed with an arcuate slot through which the bolt extends. A stationary clamping seat is fixed on the right side wall. A movable clamping member is mounted on the bolt. An operating lever is pivoted to a C-shaped connector about a first pivot, and is pivoted to the right side wall about a second pivot. When the bolt is moved to a locking position, the linking member counteracts the clamping force, which results in a pulling force that pulls the C-shaped connector in a direction toward the left side wall along a horizontal line defined by the bolt and the operating lever is prevented from being turned upwardly by the pulling force.

6 Claims, 9 Drawing Sheets

CHAIR WITH A LOCKING UNIT

BACKGROUND OF THE INVENTION

1. Field of the Invention

The invention relates to a chair, more particularly to a chair which is provided with a locking unit for locking a backrest or a seat relative to a stationary frame after adjustment of an angle between the backrest or the seat and the stationary frame.

2. Description of the Related Art

Referring to FIGS. 1 to 3, a conventional chair 1 is shown to include a chair seat 130, a backrest 140, a backrest support arm 16, a backrest bracket 161, a seat frame 15, a linking member 121, and a locking unit 17.

As illustrated, the seat frame 15 is disposed under the seat 130, and has opposite left and right sidewalls 151,152. The backrest bracket 161 is disposed rearwardly of the seat frame 15, and has an upper portion 1611 disposed between and pivoted to the left and right side walls 151,152 of the seat frame 15 so as to be turnable relative to the seat frame 15.

The backrest support arm 16 has a top connected to the backrest 140, and a bottom connected to the backrest bracket 161 so as to be turnable therewith.

The linking member 121 has a front part disposed between the left and right side walls 151,152 of the seat frame 15 and formed with an arcuate slot 123 defined by a slot defining wall, and a rear part connected to a lower portion 1612 of the backrest bracket 161 so as to be movable therealong.

The locking unit 17 includes a stationary clamping seat 18, a movable bolt 122, a movable clamping member 125, a cam member 171, and an operating lever 172. The stationary clamping seat 18 is mounted on the right side wall 152 of the seat frame 15, has a clamping end 180 disposed between the right side wall 152 and the front part of the linking member 121. The movable bolt 122 has opposite left and right ends, and extend through the left and right side walls 151,152 of the seat frame 15, the clamping end 180 of the stationary clamping seat 18, and the arcuate slot 123 in the linking member 121 in such a manner that the slot-defining wall moves relative to the movable bolt 122 so as to prevent interference between the linking member 121 and the movable bolt 122 when the linking member 121 turns together with the backrest bracket 161 relative to the seat frame 15. The movable clamping member 125, which is in the form of a tubular sleeve, is sleeved on the movable bolt 122 so as to be movable therewith. The cam member 171 is pivoted to the seat frame 15 via a pivot 175, and has two cam faces 173,174 for abutting against a head end of the movable bolt 122. The operating lever 172 is fixed to and extends outwardly from the cam member 171. The operating lever 172 is turnable downwardly about the pivot 175 so as to move the movable bolt 122 to a locking position, in which the bolt 122 is urged by a high strength coil spring 124 to move toward the right side wall 152 and to abut against the cam face 174, and in which a clamping end of the movable clamping member 125 cooperates with the clamping end 180 of the stationary clamping seat 18 to provide a clamping force to clamp the linking member 121 so as to immobilize the linking member 121 relative to the seat frame 15 and so as to prevent turning of the backrest bracket 161 with respect to the left and right side walls 151,152 of the seat frame 15. The operating lever 172 is turnable upwardly about the pivot 175 so as to move the movable bolt 122 to an unlocking position, in which the cam face 173 abuts against the head end of the movable bolt 122, and in which the movable bolt 122 moves against the urging force of the spring 124 toward the left side wall 151 of the seat frame 15 so as to release the linking member 121 from being clamped between the movable clamping member 125 and the stationary clamping seat 18.

Some disadvantages encountered during use of the aforesaid conventional chair 1 are as follows:

In order to move the movable bolt 122 between the locking and unlocking positions, a high strength coil spring 124 is employed in the conventional chair. Such type of spring 124 is costly to manufacture. In addition, the spring 124 will suffer from spring fatigue after long term use and will, in turn, affect the locking effect of the locking unit 17.

Furthermore, the cam member 171 has to be manufactured from a high strength material, such as metal, so as to withstand the high compression force of the spring 124. As such, the manufacturing cost is relatively high.

SUMMARY OF THE INVENTION

The object of this invention is to provide a chair that is provided with a locking unit which can be manufactured from low cost materials so as to eliminate the aforesaid disadvantages resulted.

Accordingly, a chair of the present invention includes a seat frame, a backrest bracket, a backrest support arm, a linking member, and a locking unit. The seat frame has opposite left and right side walls. The backrest bracket is disposed rearwardly of the seat frame, and has an upper portion disposed between and pivoted to the left and right side walls so as to be turnable relative to the seat frame. The backrest support arm has a bottom connected to the backrest bracket so as to be turnable together therewith. The linking member has a front part which is disposed between the left and right side walls of the seat frame and which is formed with an arcuate slot, and a rear part which is connected to a lower portion of the backrest bracket so as to be movable therewith. The locking unit includes a stationary clamping seat, a movable bolt, a movable clamping member, a generally C-shaped connector, and an operating lever. The stationary clamping seat is mounted on the right side wall of the seat frame, and has a clamping end that is disposed between the right side wall and the front part of the linking member. The movable bolt has opposite left and right ends, and extends through the left and right side walls of the seat frame, the clamping end of the stationary clamping seat, and the arcuate slot which permits the linking member to move past the movable bolt without interfering the movable bolt when the linking member turns with the backrest bracket relative to the seat frame. The movable clamping member is mounted on the movable bolt, and has a clamping end that is disposed between the left side wall of the seat frame and the front part of the linking member so as to be movable along with the movable bolt. The C-shaped connector has a left section connected to the right end of the movable bolt at a contact point, and a right section. The operating lever has a left end pivoted to the right section of the C-shaped connector about a first pivot, and a left extension which extends from the left end of the operating lever toward the left section of the C-shaped connector and which is pivoted to the right side wall of the seat frame about a second pivot. The second pivot extends parallel to the first pivot, and is located between the left and right sections of the C-shaped connector. The operating lever is turnable upwardly and downwardly so as to move the movable bolt via the C-shaped connector between a locking position, in which the clamping end of the movable clamping member cooperates with the clamping end of the stationary clamping seat to provide a clamping force to clamp the linking member so as to immobilize the linking member relative to the seat frame and so as to prevent turning of the backrest bracket with respect to the left and right side walls of the seat frame, and an unlocking position, in which the movable bolt moves toward the left side wall of the seat frame so as to release the linking member from being clamped between the movable clamping member and the stationary clamping seat. When the movable bolt is at the locking position, the linking member counteracts the clamping force, which results in a pulling force that pulls the left end of the operating lever in a direction toward the left side wall along a horizontal line defined by the movable bolt. Under this condition, the second pivot and the contact point of the C-shaped connector cooperatively define an imaginary line that extends in a direction transverse to the horizontal line and that is disposed above the first pivot so that the operating lever is prevented from being turned upwardly by the pulling force.

BRIEF DESCRIPTION OF THE DRAWINGS

Other features and advantages of this invention will become more apparent in the following detailed description of the preferred embodiment of this invention, with reference to the accompanying drawings.

DETAILED DESCRIPTION OF THE PREFERRED EMBODIMENT

Figure 1:
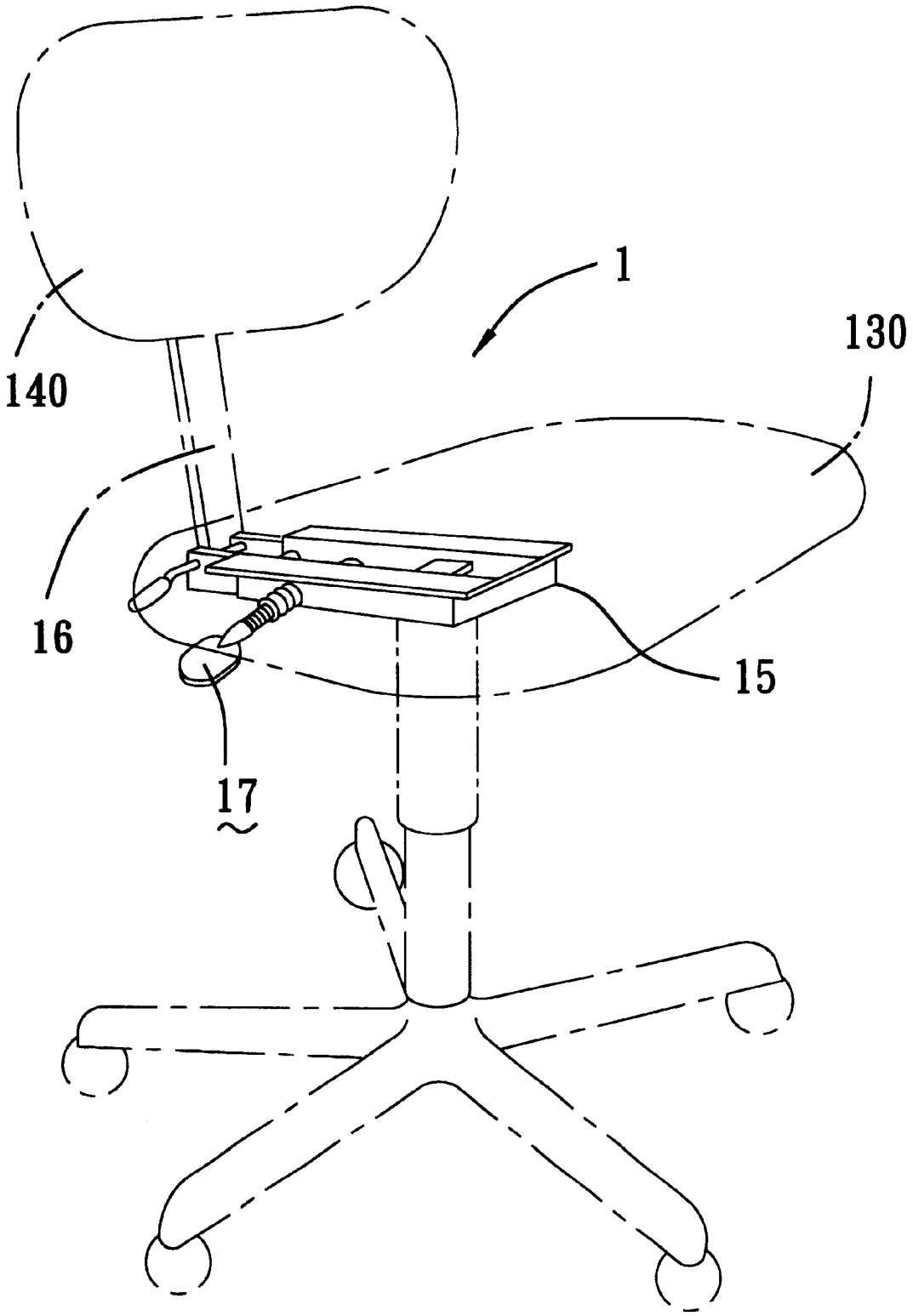
FIG. 1 PRIOR ART
FIG. 1 is a perspective view of a conventional chair.
Figure 2:
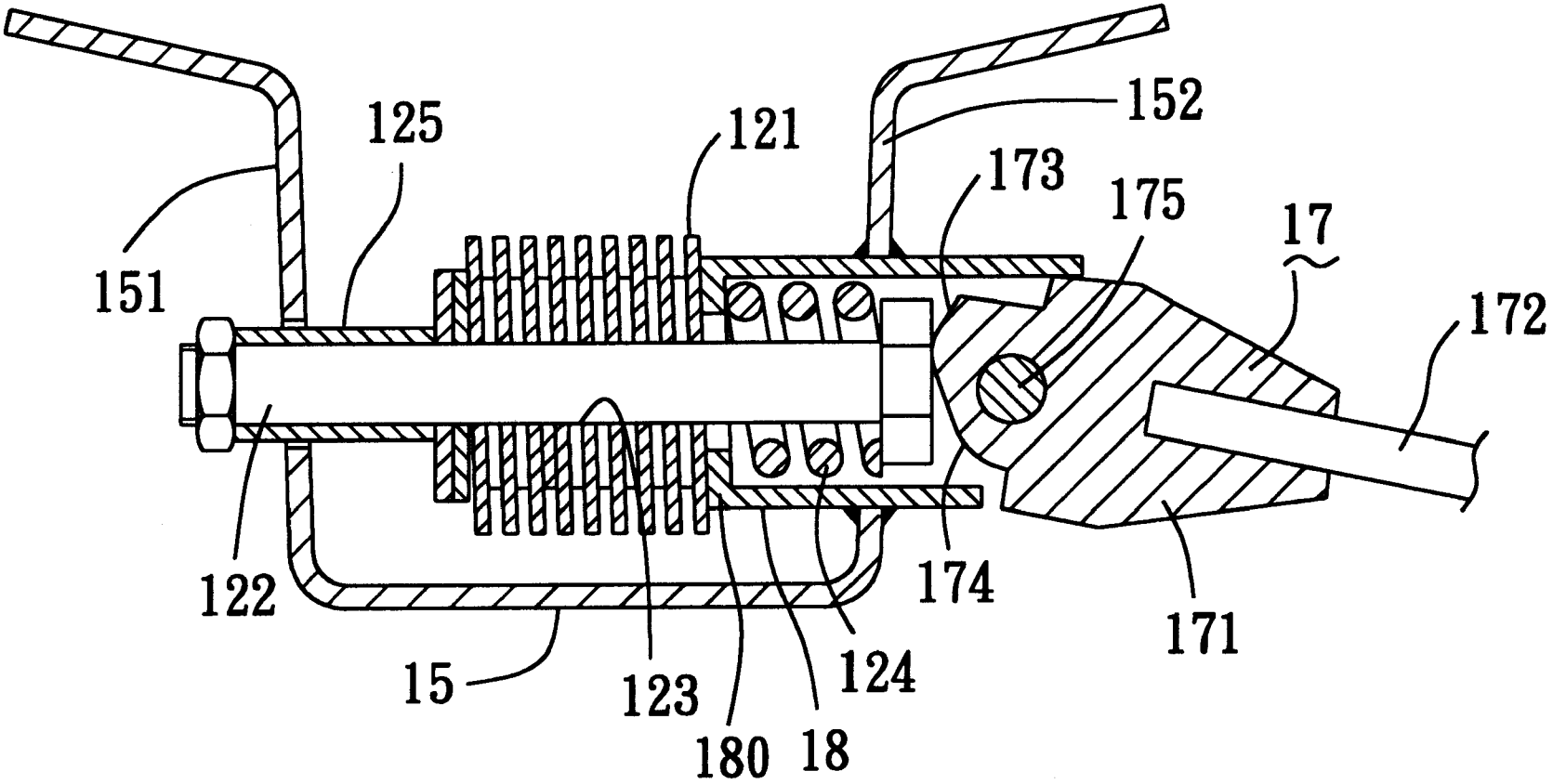
FIG. 2 PRIOR ART
FIG. 2 is a partly sectional view of the conventional chair with a seat removed therefrom in order to illustrate mounting of a locking unit on a seat frame that is disposed underside of the seat.
Figure 3:
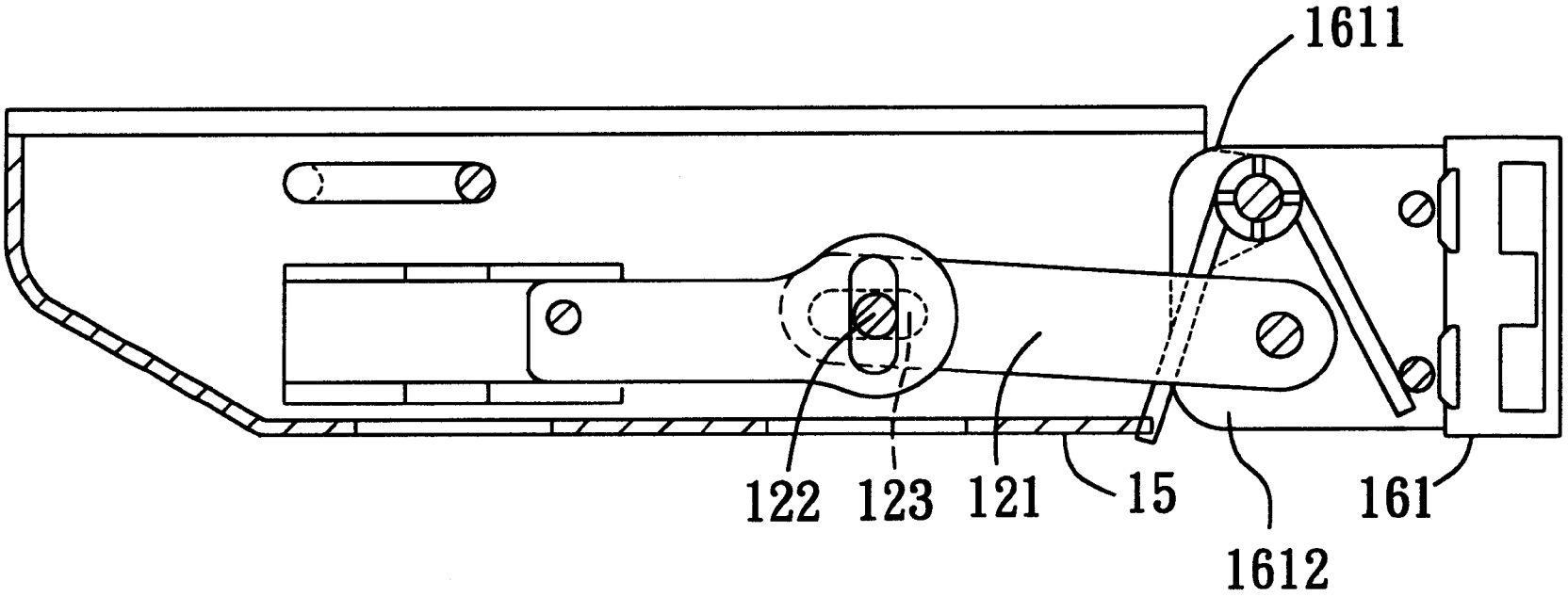
FIG. 3 PRIOR ART
FIG. 3 is a schematic side view of the seat frame and the locking unit shown in FIG. 2.
Figure 4:
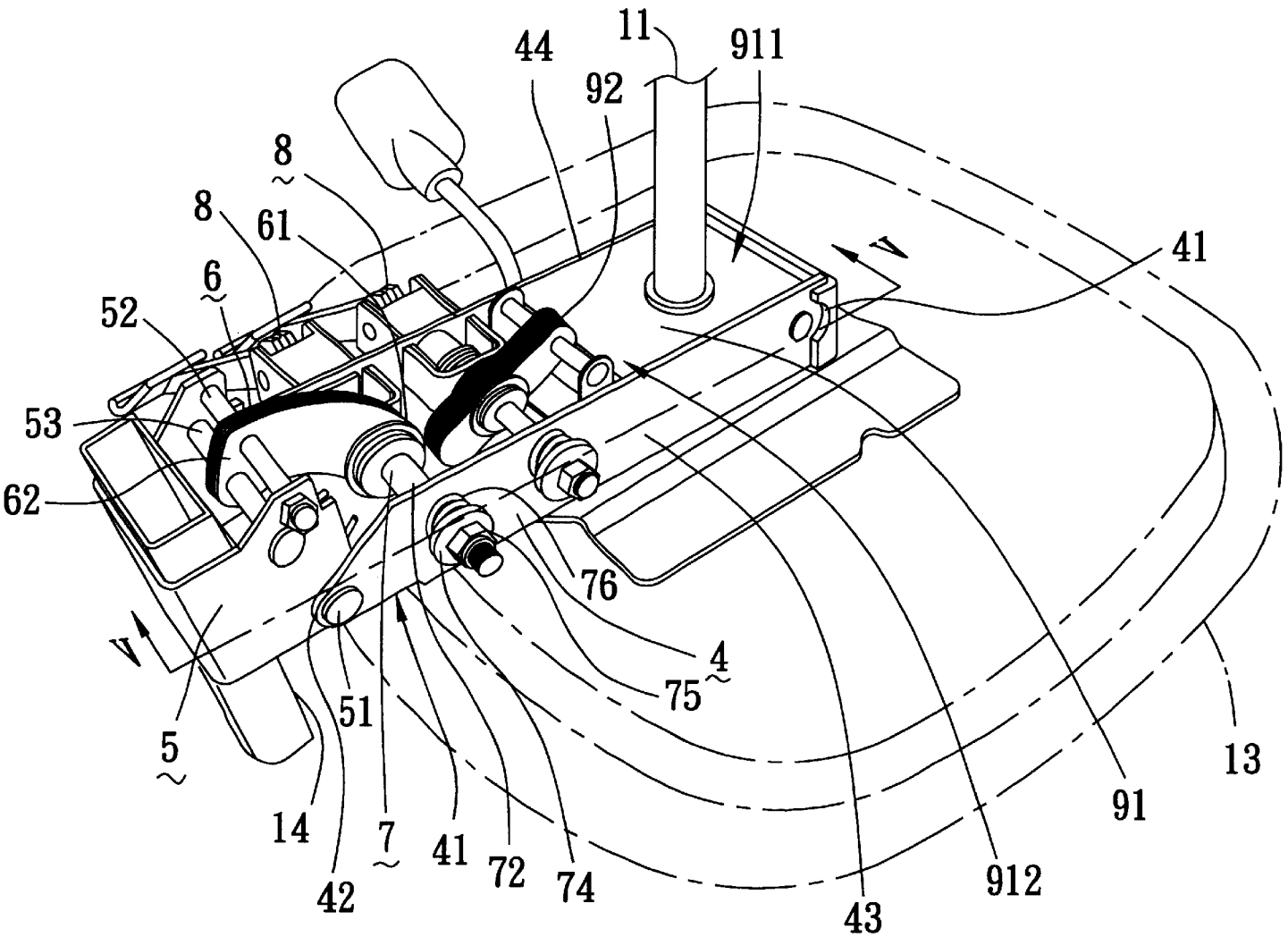
FIG. 4 is a perspective bottom view of the preferred embodiment of a chair according to the present invention, illustrating interconnection between a locking unit and a seat frame disposed below a chair seat of the preferred embodiment.

Referring to FIGS. 4 to 7, the preferred embodiment of a chair according to this invention is shown to include a seat frame 4, a backrest bracket 5, a backrest support arm 14 of rectangular cross section, a linking member 6, and a locking unit 7.

As illustrated, the seat frame 4 is disposed under a chair seat 13, and has opposite left and right side walls 43,44 with front and rear ends 41,42.

The backrest bracket 5 is disposed rearwardly of the seat frame 4, and has upper and lower portions. The upper portion is disposed between and pivoted to the rear ends 42 of the left and right side walls 43,44 by a pivot 51 such that the backrest bracket 5 is turnable relative to the seat frame 4.

The backrest support arm 14 has an upper end connected to a backrest (not shown) and a bottom connected securely to the backrest bracket 5 in such a manner that the support arm 14 turns together with the backrest bracket 5.

The linking member 6 has a front part 61 which is disposed between the left and right side walls 43,44 of the seat frame 4, and which is formed with an arcuate slot 63 defined by a slot-defining wall and a rear part 62 which is connected to the lower portion of the backrest bracket 5 via two pivots 52,53 which extend parallel to the pivot 51 such that the linking member 6 is movable with the backrest bracket 5.

Figure 5:
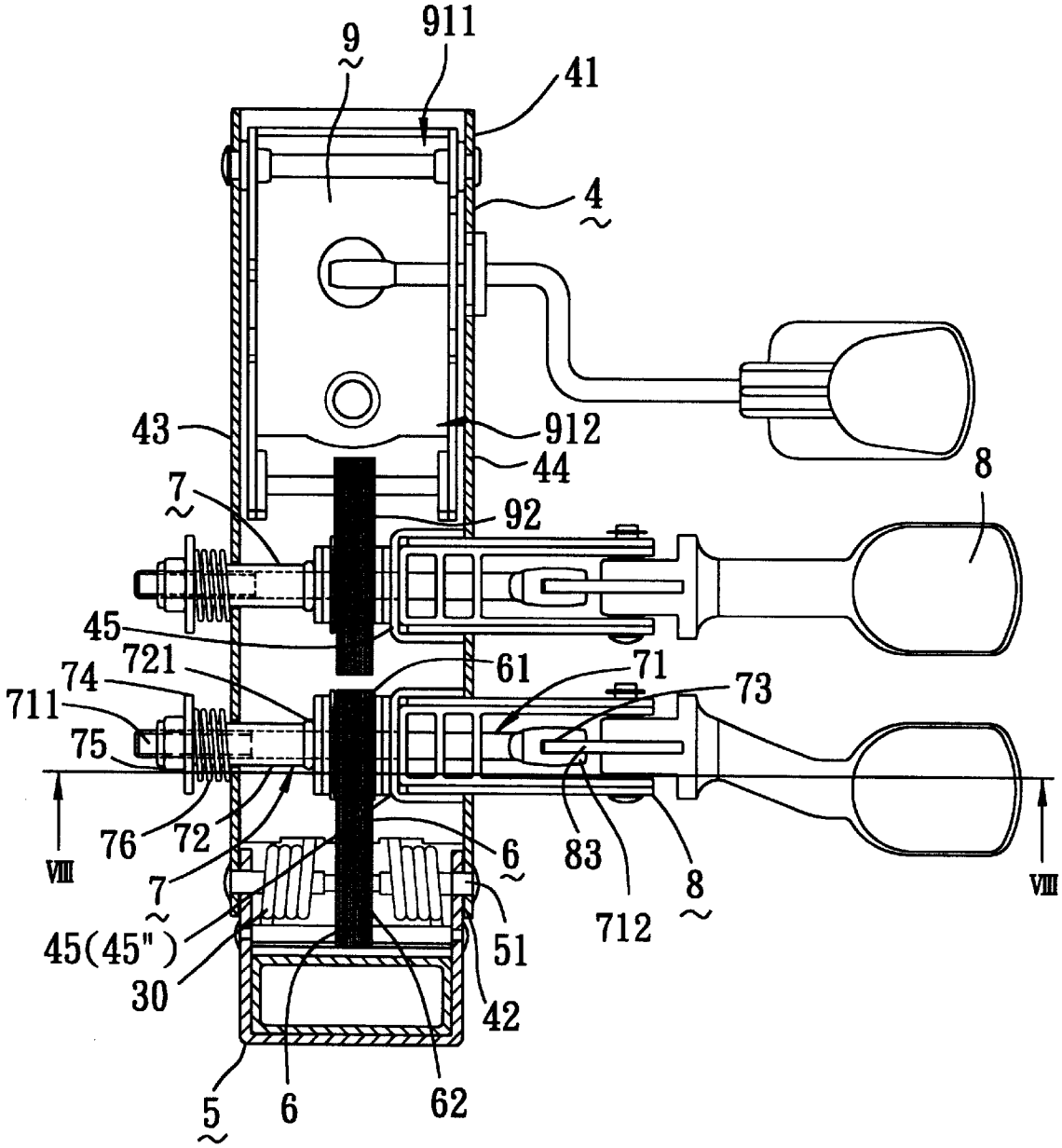
FIG. 5 is a partly sectional view of the preferred embodiment taken along lines V—V of FIG. 4.
Figure 6:
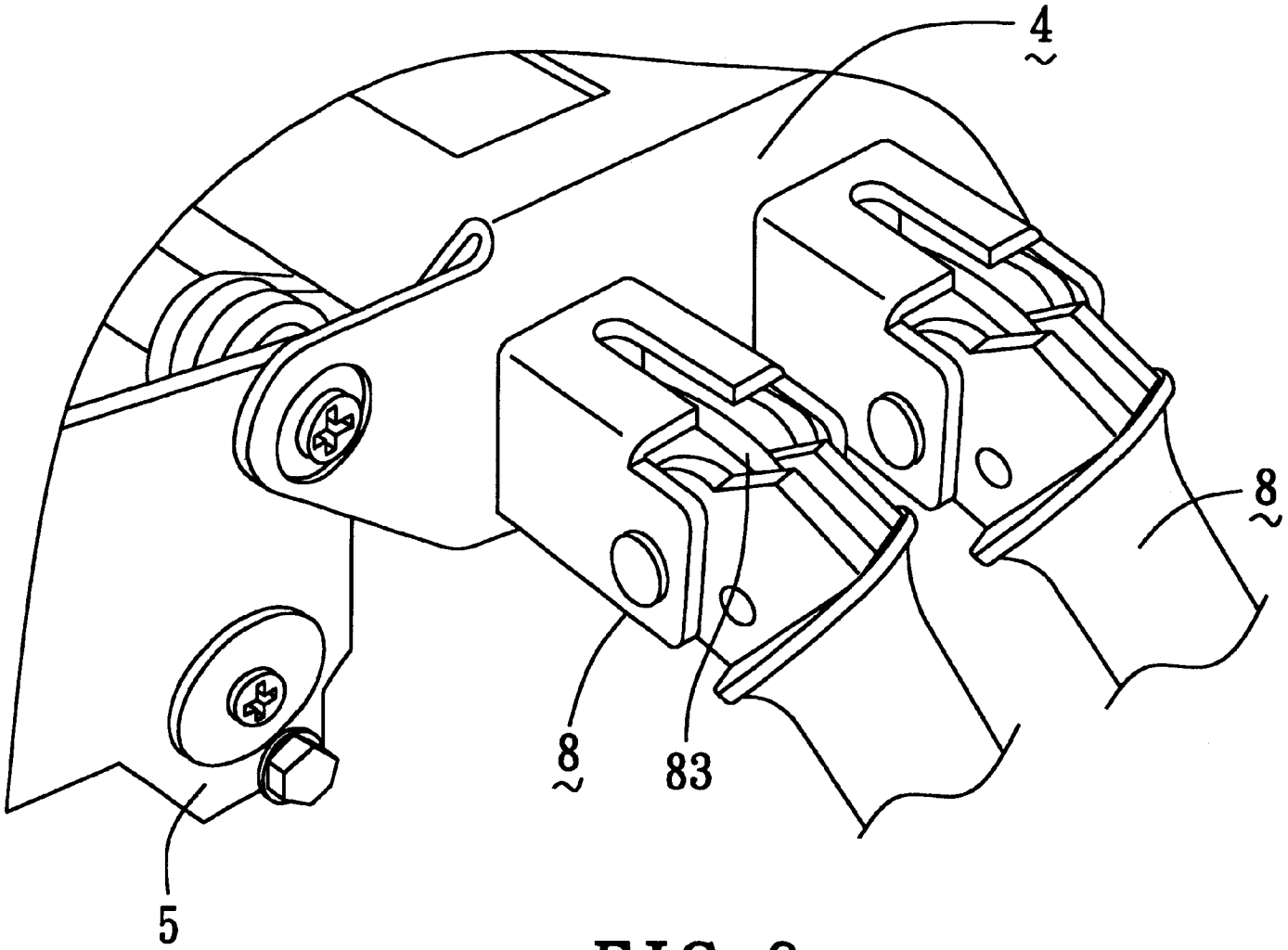
FIG. 6 is a fragmentary view of the preferred embodiment, illustrating how an operating lever of the locking unit is mounted on the seat frame.
Figure 8:
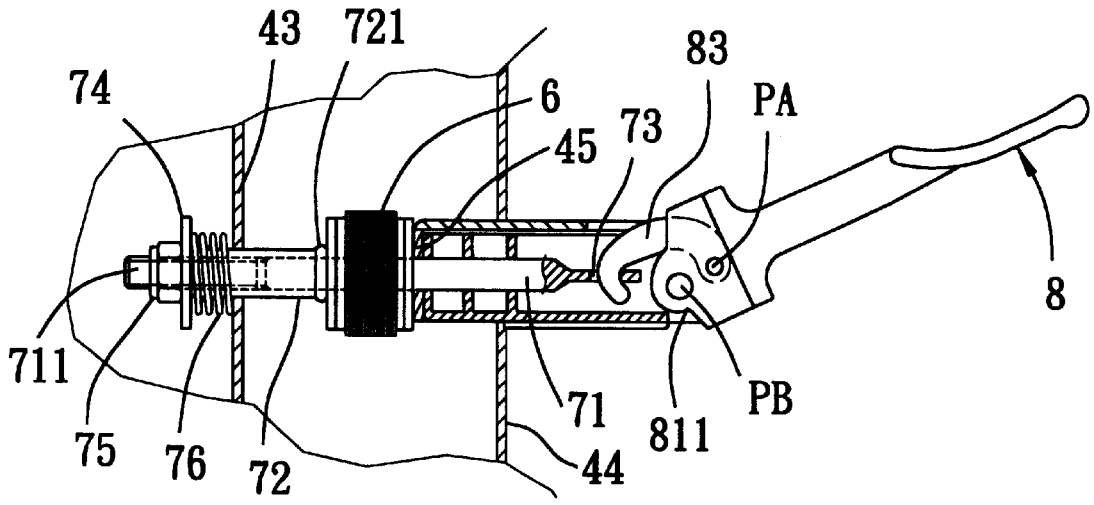
FIG. 8 is a partly sectional view of the preferred embodiment taken along line VIII—VIII of FIG. 5, illustrating a condition, in which the linking member interconnecting the seat frame and the backrest support arm is released from being clamped so as to permit tilting of the backrest support arm relative to the seat frame.

The locking unit 7 includes a stationary clamping seat 45 (see FIG. 5), a movable bolt 71, a movable clamping member 72, a generally C-shaped connector 83 (see FIG. 8), and an operating lever 8. The stationary clamping seat 45 is mounted on the seat frame 4, and has a clamping end 45" disposed between the right side wall 44 and the front part 61 of the linking member 6. The movable bolt 71 has opposite left and right ends 711,712 and extends through the left and right side walls 43,44 of the seat frame 4, the clamping end 45" of the stationary clamping seat 45, and the arcuate slot 63 which permits the linking member 6 to move past the movable bolt 71 without interfering the movable bolt 71 when the linking member 6 turns with the backrest bracket 5 relative to the seat frame 4. The movable clamping member 72 is mounted on the movable bolt 71, and has a clamping end 721 disposed between the left side wall 43 and the front part 61 of the linking member 6 so as to be movable with the movable bolt 71. Referring to FIGS. 5, 8 and 10, the C-shaped connector 83 has a hooking left section which extends into a hole 73 that is formed through the right end 712 of the movable bolt 71 and that is defined by a hole-defining wall such that the hooking left section contacts the hole-defining wall at a contact point (PC). The operating lever 8 has a left end pivoted to a right section of the C-shaped connector 83 about a first pivot (PA), and a left extension 811 which extends from the left end of the operating lever 8 toward the left section of the C-shaped connector 83, and which is pivoted to the right side wall 44 of the seat frame 4 about a second pivot (PB) in such a manner that the second pivot (PB) extends parallel to the first pivot (PA). The second pivot (PB) is located between the left and right sections of the C-shaped connector 83. The operating lever 8 is movable downwardly about the second pivot (PB) so as to move the movable bolt 71 via the C-shaped connector 83 to a locking position (see FIG. 9), in which the clamping end 721 of the movable clamping member 72 cooperates with the clamping end 45" of the stationary clamping seat 45 to provide a clamping force to clamp the linking member 6 so as to immobilize the linking member 6 relative to the seat frame 4, and so as to prevent turning of the backrest bracket 5 with respect to the left and right side walls 43,44. The operating lever 8 is turnable upwardly about the second pivot (PB) so as to move the movable bolt 71 to an unlocking position (see FIG. 8), in which the movable bolt 71 moves toward the left side wall 43 of the seat frame 4 so as to release the linking member 6 from being clamped between the movable clamping member 72 and the stationary clamping seat 45. Under this condition, the backrest support arm 14 can be tilted relative to the seat frame 4 by virtue of synchronous movement of the linking member 6 with the backrest bracket 5. Preferably, the linking member 6 may consist of a plurality of parallelly disposed and spaced apart clamping plates. Since the features of the subject invention do not reside in the specific configuration of the linking member 6, a detailed disclosure of the same will be omitted herein for the sake of brevity.

Figure 9:
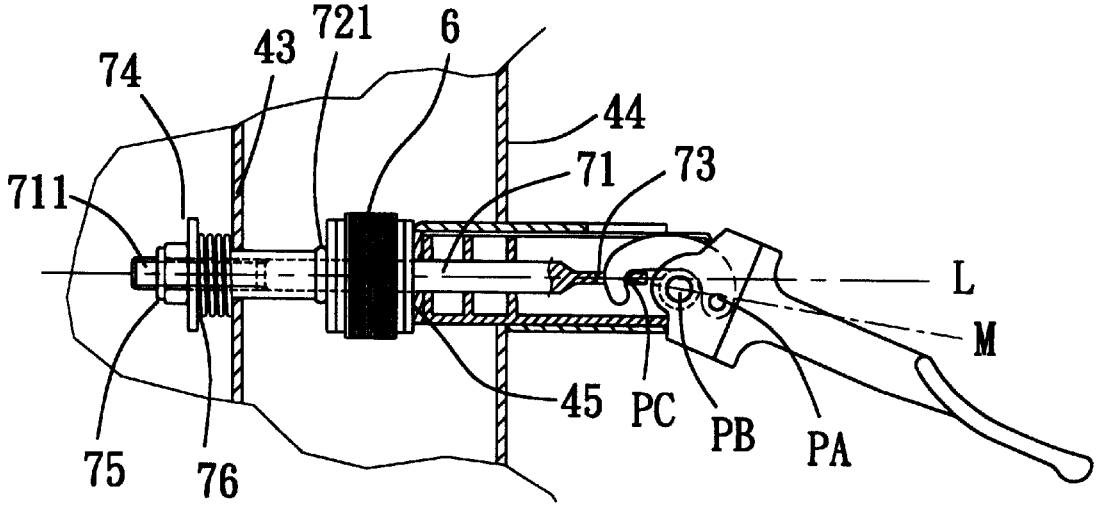
FIG. 9 is a partly sectional view of the preferred embodiment, illustrating a condition, in which the linking member is clamped so as to prevent tilting of the backrest support arm relative the seat frame.
Figure 10:
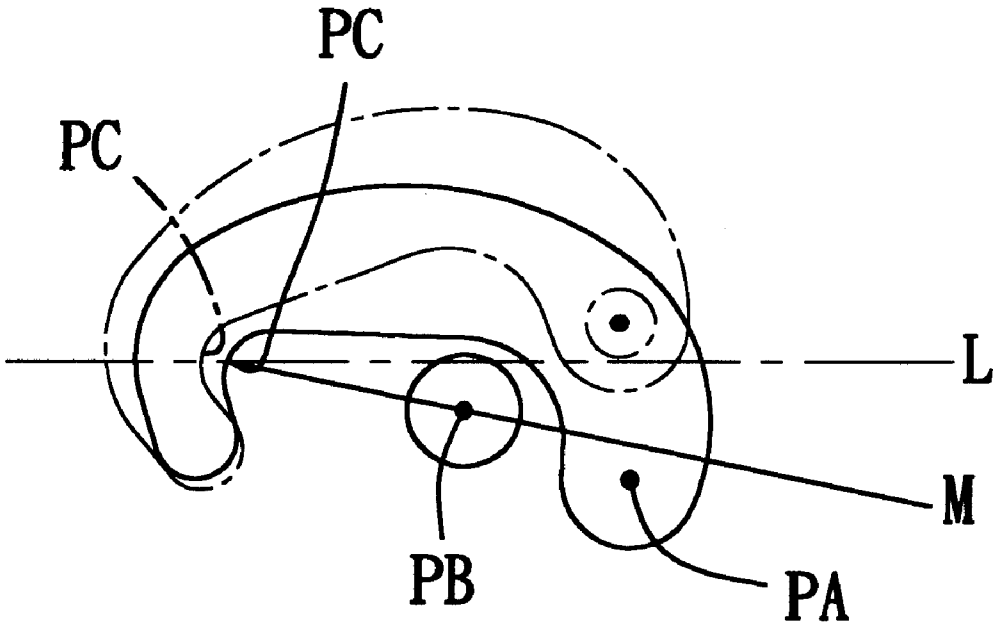
FIG. 10 depicts a side elevation view of the C-shaped connector 83.

When the movable bolt 71 is at the locking position, as best shown in FIGS. 9 and 10, the linking member 6 counteracts the clamping force, which results in a pulling force that pulls the left end of the operating lever 8 in a direction toward the left side wall 43 along a horizontal line (L) defined by the movable bolt 71. Under this condition, the contact point (PC) of the C-shaped connector 83 and the second pivot (PB) cooperatively define an imaginary line (M) that extends in a direction transverse to the horizontal line (L) and that is disposed above the first pivot (PA) such that the operating lever 8 extends inclinedly and downwardly from the horizontal line (L). The operating lever 8 is prevented from being turned upwardly by the pulling force.

In this preferred embodiment, the movable clamping member 72 is in the form of a tubular sleeve, and extends through a hole in the left side wall 43 of the seat frame 4. The tubular sleeve is disposed around the left end 711 of the movable bolt 71. A fastener nut 75 is mounted threadedly on the left end 711 of the movable bolt 71. A coil spring 76 is sleeved on the tubular sleeve between the fastener nut 75 and the left side wall 43, and abuts against the fastener nut 75 and the left side wall 43 for urging the fastener nut 75 and the tubular sleeve via a washer 74 so as to facilitate smooth movement of the movable bolt 71 between the locking and unlocking positions when the operating lever 8 turns upwardly and downwardly about the second pivot (PB).

Referring once again to FIGS. 4 and 7, a seat bracket 91 is disposed in the seat frame 4 and frontwardly of the backrest bracket 5, and has a front part 911 fixed on a chair leg 11, and a rear part with upper and lower portions. The upper portion of the rear part of the seat bracket 91 is disposed between and is pivoted to the left and right side walls 43,44 of the seat frame 4 so as to be turnable relative to the seat frame 4.

Figure 7:
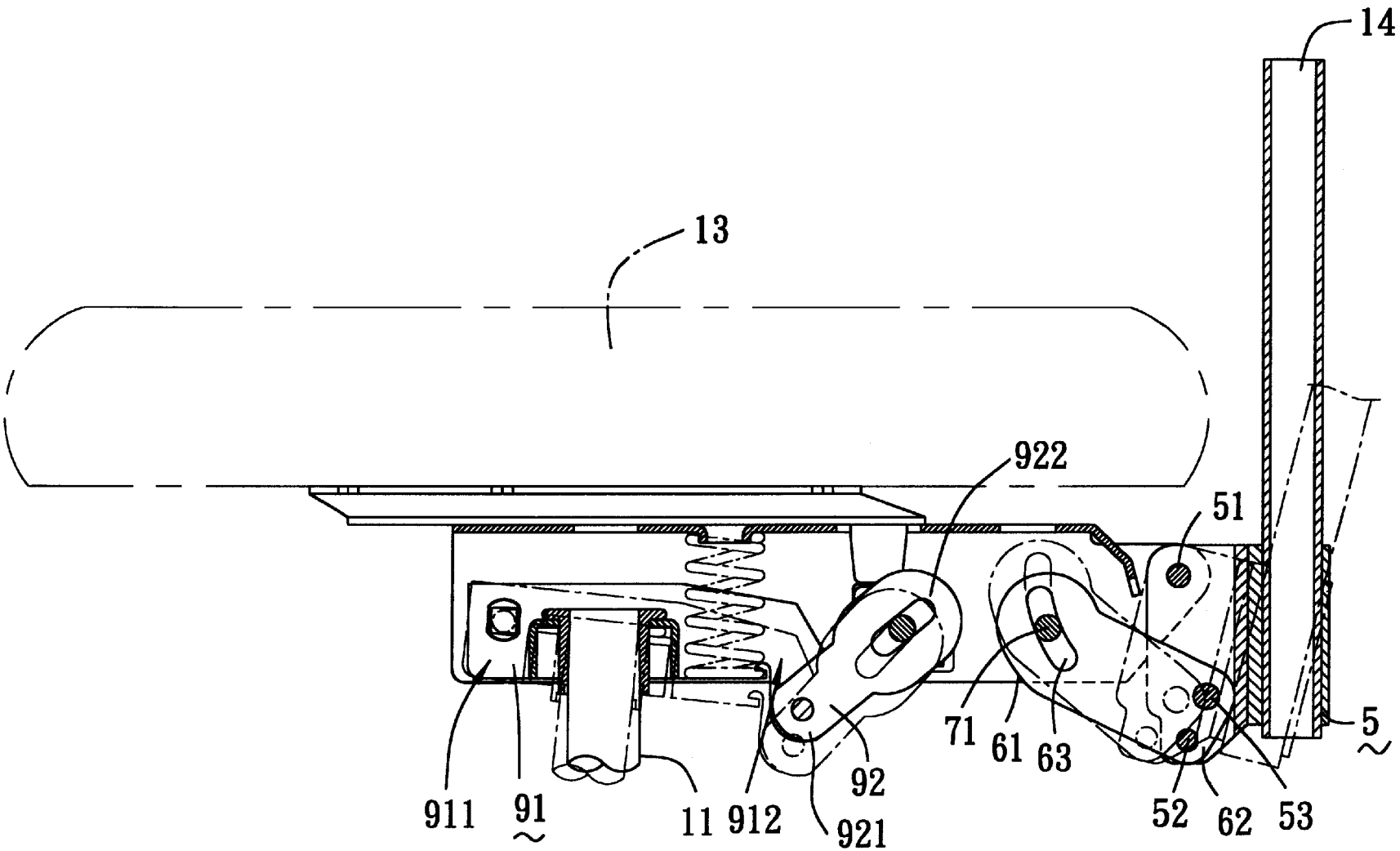
FIG. 7 is a partly sectional side view of the preferred embodiment, illustrating how a backrest support arm is tilted relative to the seat frame by virtue of synchronous movement of a linking member with the backrest support arm relative to the seat frame.

A linking member 92 is disposed in the seat frame 4 between the backrest bracket 5 and the seat bracket 91, and has a front part 921 connected to the lower portion of the rear part of the seat bracket 91 so as to be movable therealong, and a rear part 922 formed with an arcuate slot (see FIG. 7).

In the present invention, an additional locking unit which has the same components as those of the aforesaid locking unit is employed to clamp and release the linking member 92 relative to the seat frame 4, thereby resulting adjustment of the angle of the seat 13 relative to the leg unit 11.

Note that there is no need to employ a strong strength coil spring in the locking unit 7 of the present invention. In addition, the C-shaped connector 83 and the operating lever 8 can be fabricated from relatively cheap material, such as plastics, without adversely affecting the locking effect of the locking unit. The features of the invention are thus achieved.

With this invention thus explained, it is apparent that numerous modifications and variations can be made without departing from the scope and spirit of this invention. It is therefore intended that this invention be limited only as indicated in the appended claims.

I claim:

1. A chair comprising:

a seat frame having opposite left and right side walls;

a backrest bracket disposed rearwardly of said seat frame, having a lower portion, and an upper portion disposed between and pivoted to said left and right side walls so as to be turnable relative to said seat frame;

a backrest support arm having a bottom connected to said backrest bracket so as to be turnable therewith;

a linking member having a front part disposed between said left and right side walls and formed with an arcuate slot and a rear part connected to said lower portion of said backrest bracket so as to be movable therewith; and a locking unit including a stationary clamping seat mounted on said right side wall, and having a clamping end disposed between said right side wall and said front part of said linking member, a movable bolt having opposite left and right ends and extending through said left and right side walls, said clamping end, and said arcuate slot which permits said linking member to move past said movable bolt without interfering said movable bolt when said linking member turns together with said backrest bracket relative to said seat frame, a movable clamping member mounted on said movable bolt, and having a clamping end disposed between said left side wall and said front part of said linking member so as to be movable along with said movable bolt, a generally C-shaped connector having a right section and a left section connected to and in contact with said right end of said movable bolt at a contact point, an operating lever having a left end pivoted to said right section of said C-shaped connector about a first pivot, and a left extension which extends from said left end of said operating lever toward said left section of said C-shaped connector and which is pivoted to said right side wall of said seat frame about a second pivot that extends parallel to said first pivot, and that is located between said left and right sections of said C-shaped connector, said operating lever being turnable upwardly and downwardly so as to move said movable bolt via said C-shaped connector between a locking position, in which said clamping end of said movable clamping member cooperates with said clamping end of said stationary clamping seat to provide a clamping force to clamp said linking member so as to immobilize said linking member relative to said seat frame and so as to prevent turning of said backrest bracket with respect to said left and right side walls, and an unlocking position, in which said movable bolt moves toward said left side wall of said seat frame so as to release said linking member from being clamped between said movable clamping member and said stationary clamping seat.

2. The chair as defined in claim 1, wherein said linking member counteracts said clamping force when said movable bolt is at said locking position, which results in a pulling force that pulls said left end of said operating lever in a direction toward said left side wall along a horizontal line defined by said movable bolt, said second pivot and said contact point cooperatively defining an imaginary line that extends in a direction transverse to said horizontal line and that is disposed above said first pivot such that said operating lever is prevented from being turned upwardly by said pulling force when said movable bolt is at said locking position.

3. The chair as defined in claim 1, wherein said movable clamping member is in the form of a tubular sleeve extending through said left side wall and disposed around said left end of said movable bolt, said chair further comprising a fastener nut mounted threadedly on said left end of said movable bolt, and a coil spring sleeved on said tubular sleeve between said fastener nut and said left side wall and abutting against said fastener nut and said left side wall for urging against said fastener nut and said tubular sleeve so as to facilitate smooth movement of said movable bolt between said locking and unlocking positions when said operating lever turns upwardly and downwardly about said second pivot.

4. A chair comprising:

a seat frame having opposite left and right side walls;

a backrest bracket disposed rearwardly of and turnable relative to said seat frame;

a seat bracket disposed in said seat frame and frontwardly of said backrest bracket, and having a lower portion, and an upper portion disposed between and pivoted to said left and right side walls so as to be turnable relative to said seat frame;

a linking member disposed in said seat frame between said backrest bracket and said seat bracket, and having a front part connected to said lower portion of said seat bracket so as to be movable therewith, and a rear part formed with an arcuate slot; and a locking unit including a stationary clamping seat mounted on said right side wall, and having a clamping end disposed between said right side wall and said front part of said linking member, a movable bolt having opposite left and right ends and extending through said left and right side walls, said clamping end, and said arcuate slot which permits said linking member to move past said movable bolt without interfering said movable bolt when said linking member turns together with said seat bracket relative to said seat frame, a movable clamping member mounted on said movable bolt, and having a clamping end disposed between said left side wall and said front part of said linking member so as to be movable along with said movable bolt, a generally C-shaped connector having a left section connected to and in contact with said right end of said movable bolt at a contact point, and a right section, and an operating lever having a left end pivoted to said right section of said C-shaped connector about a first pivot, and a left extension which extends from said left end of said operating lever toward said left section of said C-shaped connector and which is pivoted to said right side wall of said seat frame about a second pivot that extends parallel to said first pivot, and that is located between said left and right sections of said C-shaped connector, said operating lever being turnable upwardly and downwardly about said second pivot so as to move said movable bolt via said C-shaped connector between a locking position, in which said clamping end of said movable clamping member cooperates with said clamping end of said stationary clamping seat to provide a clamping force to clamp said linking member so as to immobilize said linking member relative to said seat frame and so as to prevent turning of said seat bracket with respect to said left and right side walls, and an unlocking position, in which said movable bolt moves toward said left side wall of said seat frame so as to release said linking member from being clamped between said movable clamping member and said stationary clamping seat.

5. The chair as defined in claim 4, wherein said linking member counteracts said clamping force when said movable bolt is at said locking position, which results in a pulling force that pulls said left end of said operating lever in a direction toward said left side wall along a horizontal line defined by said movable bolt, said second pivot and said contact point cooperatively defining an imaginary line that extends in a direction transverse to said horizontal line and that is disposed above said first pivot such that said operating lever is prevented from being turned upwardly by said pulling force when said movable bolt is at said locking position.

6. The chair as defined in claim 4, wherein said movable clamping member is in the form of a tubular sleeve extending through said left side wall and disposed around said left end of said movable bolt, said chair further comprising a fastener nut mounted threadedly on said left end of said movable bolt, and a coil spring sleeved on said tubular sleeve between said fastener nut and said left side wall and abutting against said fastener nut and said left side wall for urging against said fastener nut and said tubular sleeve so as to facilitate smooth movement of said movable bolt between said locking and unlocking positions when said operating lever turns upwardly and downwardly about said second pivot.

* * * * *